US009618896B2

(12) United States Patent
Tanaka

(10) Patent No.: US 9,618,896 B2
(45) Date of Patent: Apr. 11, 2017

(54) PAPER SHEET CONVEYING APPARATUS AND IMAGE FORMING SYSTEM

(71) Applicant: Konica Minolta Inc., Tokyo (JP)

(72) Inventor: Yu Tanaka, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/808,457

(22) Filed: Jul. 24, 2015

(65) Prior Publication Data

US 2016/0054697 A1 Feb. 25, 2016

(30) Foreign Application Priority Data

Aug. 21, 2014 (JP) ..... 2014-168418

(51) Int. Cl.
*G03G 15/00* (2006.01)
*B65H 29/12* (2006.01)
(Continued)

(52) U.S. Cl.
CPC ..... *G03G 15/70* (2013.01); *B26D 5/32* (2013.01); *B65H 29/125* (2013.01); *B65H 29/14* (2013.01); *B65H 29/58* (2013.01); *B65H 31/24* (2013.01); *B65H 43/04* (2013.01); *G03G 15/6573* (2013.01); *G03G 15/6582* (2013.01);
(Continued)

(58) Field of Classification Search
CPC ..... G03G 15/6517; G03G 15/652; G03G 15/6523; G03G 15/6526; G03G 15/70; G03G 2215/00552; G03G 2221/1675; B41J 11/006; B65H 2601/11; B65H 2601/111
See application file for complete search history.

(56) References Cited

U.S. PATENT DOCUMENTS 6,056,460 A * 5/2000 Suzuki ..... B65H 29/62 400/582
6,557,849 B2 * 5/2003 Wyss ..... B65H 7/00 271/259

FOREIGN PATENT DOCUMENTS

JP H07-264348 A 10/1995
JP H10-181125 A 7/1998
JP H10-198098 A 7/1998

OTHER PUBLICATIONS

Notice of Reasons for Refusal dated Sep. 1, 2016 from the corresponding Japanese Application; Patent Application No. 2014-168418; Total of 11 pages.
(Continued)

*Primary Examiner* — Justin Olamit
(74) *Attorney, Agent, or Firm* — Lucas & Mercanti, LLP

(57) ABSTRACT

A paper sheet conveying apparatus includes: a first storage unit; a second storage unit; a first conveyance path to the first storage unit; a second conveyance path to the second storage unit; a conveyance unit configured to convey a paper sheet; a switching unit configured to switch a conveyance path of a paper sheet; a cutting unit configured to cut a paper sheet at a cutting position; a detecting unit configured to detect a jam; and a control unit, when a jam is detected on the first conveyance path, configured to cut a part of the paper sheet, the part is positioned on a side upstream from the cutting position, to a predetermined length, switch a conveyance path of the paper sheet from the first conveyance path to the second conveyance path, and store the cut paper sheet in the second storage unit through the second conveyance path.

10 Claims, 11 Drawing Sheets

(51) Int. Cl.

| | |
|---|---|
| ***B65H 29/14*** | (2006.01) |
| ***B65H 29/58*** | (2006.01) |
| ***B65H 31/24*** | (2006.01) |
| ***B65H 43/04*** | (2006.01) |
| ***B26D 5/32*** | (2006.01) |

(52) U.S. Cl.

CPC ..... *B65H 2301/51512* (2013.01); *B65H 2301/533* (2013.01); *B65H 2404/632* (2013.01); *B65H 2511/20* (2013.01); *B65H 2511/51* (2013.01); *B65H 2511/528* (2013.01); *B65H 2601/11* (2013.01); *G03G 15/6594* (2013.01); *G03G 2215/00552* (2013.01); *G03G 2215/00814* (2013.01)

(56) References Cited

OTHER PUBLICATIONS

Office Action dated Dec. 2, 2016 from the corresponding Chinese Application/Patent No. 20151516135.8; Applicant: Konica Minolta, Inc.; English translation of Office Action; Total of 24 pages.

* cited by examiner

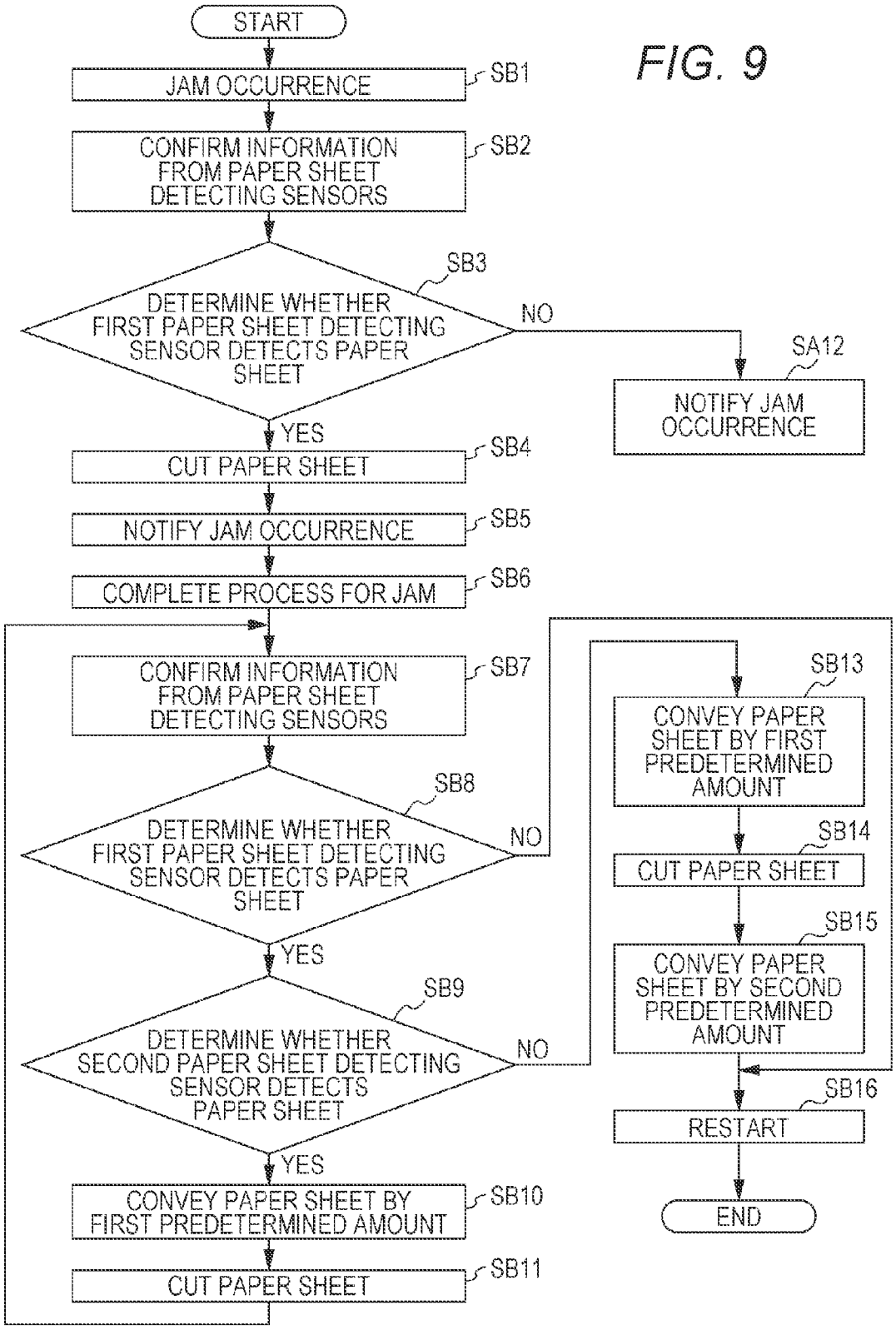
FIG. 9
START
JAM OCCURRENCE
SB1
CONFIRM INFORMATION FROM PAPER SHEET DETECTING SENSORS
SB2
DETERMINE WHETHER FIRST PAPER SHEET DETECTING SENSOR DETECTS PAPER SHEET
SB3
NO
SA12
NOTIFY JAM OCCURRENCE
YES
CUT PAPER SHEET
SB4
NOTIFY JAM OCCURRENCE
SB5
COMPLETE PROCESS FOR JAM
SB6
CONFIRM INFORMATION FROM PAPER SHEET DETECTING SENSORS
SB7
DETERMINE WHETHER FIRST PAPER SHEET DETECTING SENSOR DETECTS PAPER SHEET
SB8
NO
YES
DETERMINE WHETHER SECOND PAPER SHEET DETECTING SENSOR DETECTS PAPER SHEET
SB9
NO
YES
CONVEY PAPER SHEET BY FIRST PREDETERMINED AMOUNT
SB10
CUT PAPER SHEET
SB11
SB13
CONVEY PAPER SHEET BY FIRST PREDETERMINED AMOUNT
SB14
CUT PAPER SHEET
SB15
CONVEY PAPER SHEET BY SECOND PREDETERMINED AMOUNT
SB16
RESTART
END

PAPER SHEET CONVEYING APPARATUS AND IMAGE FORMING SYSTEM

The entire disclosure of Japanese Patent Application No. 2014-168418 filed on Aug. 21, 2014 including description, claims, drawings, and abstract are incorporated herein by reference in its entirety.

BACKGROUND OF THE INVENTION

Field of the Invention

The present invention relates to a paper sheet conveying apparatus that conveys a paper sheet, and an image forming system that includes the paper sheet conveying apparatus.

Description of the Related Art

When an image forming apparatus is connected to a paper sheet processing apparatus that performs a process, for example, for binding paper sheets, a conveyance route on which a paper sheet is conveyed is provided between the image forming apparatus and the paper sheet processing apparatus. When a jam of the conveyed paper sheet occurs and the paper sheet causing the jam is embedded in one of the image forming apparatus and the paper sheet processing apparatus, the rack including the conveyance path is drawn such that the paper sheet causing the jam is removed. Alternatively, when the paper sheet causing the jam extends over the apparatuses, the paper sheet is manually conveyed to one of the apparatuses and the rack is drawn such that the paper sheet causing the jam is removed.

However, if a long paper sheet extends over a plurality of apparatuses, it is necessary to manually convey a large amount of the paper sheet. This conveyance increases the time of removal work. Depending on the state of the paper sheet causing the jam, it may be impossible to manually convey the paper sheet causing the jam. This makes it difficult to remove the paper sheet causing the jam.

In light of the foregoing, a technique for discharging a paper sheet causing a jam from an apparatus that conveys a long paper sheet such as a roll of paper is proposed (For example, see JP 10-198098 A). In the technique, the paper sheet is drawn from the roll of paper by a length short enough to be conveyed. Then, the paper sheet is cut and discharged. A technique in which the paper sheet is cut and discharged regardless of the length of the drawn paper sheet when a jam occurs is also proposed (For example, see JP 07-264348 A).

By cutting the paper sheet causing a jam, a part in which the jam occurs can be removed. Meanwhile, a part in which the jam does not occur also needs to be removed such that the next paper sheet can be conveyed. However, it is also difficult to remove a part in which a jam does not occur in a long paper sheet. If the long paper sheet is a roll of paper, the part in which the jam does not occur can be reused. However, if a long paper sheet having a predetermined length is cut in the middle of the sheet, the part in which the jam does not occur is also not reusable. Thus, the part also needs to be removed.

SUMMARY OF THE INVENTION

The present invention has been made in order to solve the above problems, and an object thereof is to provide a paper sheet conveying apparatus in which a paper sheet causing a jam can easily be removed, and an image forming system that includes the paper sheet conveying apparatus.

To achieve the abovementioned object, according to an aspect, a paper sheet conveying apparatus reflecting one aspect of the present invention comprises: a first storage unit; a second storage unit; a first conveyance path used to convey a paper sheet to the first storage unit; a second conveyance path used to convey a paper sheet to the second storage unit; a first conveyance unit configured to convey a paper sheet along the first conveyance path and the second conveyance path; a first switching unit configured to switch a conveyance path of a paper sheet to one of the first conveyance path and the second conveyance path; a first cutting unit provided on a side upstream from the first switching unit in a paper sheet conveyance direction, and configured to cut a paper sheet at a cutting position; the first cutting unit being configured to detect an occurrence of a jam; and a control unit, when the detecting unit detects a jam in a paper sheet conveyed on the first conveyance path, configured to cut a part of the paper sheet, the part being positioned on a side upstream from the cutting position in the paper sheet conveyance direction, to a predetermined length with the first cutting unit, switch a conveyance path of the paper sheet from the first conveyance path to the second conveyance path with the first switching unit, and store the paper sheet cut to the predetermined length in the second storage unit through the second conveyance path with the first conveyance unit.

The paper sheet conveying apparatus of Item. 2 is the paper sheet conveying apparatus according to Item. 1, wherein the control unit preferably controls the first conveyance unit and the first cutting unit such that the predetermined length of a paper sheet to be cut with the first cutting unit is equal to or longer than a length long enough to be conveyed with the first conveyance unit, and equal to or shorter than a length short enough to be stored in the second storage unit.

The paper sheet conveying apparatus of Item. 3 is the paper sheet conveying apparatus according to Item. 1 or 2, preferably further comprising a notifying unit configured to notify a user of an occurrence of a jam, wherein the control unit notifies an occurrence of a jam with the notifying unit after the part positioned on the side upstream from the cutting position in the paper sheet conveyance direction is stored in the second storage unit.

The paper sheet conveying apparatus of Item. 4 is the paper sheet conveying apparatus according to Item. 1 or 2, wherein, after the jam detected with the detecting unit is resolved, the control unit preferably cuts the part positioned on the side upstream from the cutting position in the paper sheet conveyance direction to the predetermined length with the first cutting unit, and stores the paper sheet cut to the predetermined length in the second storage unit through the second conveyance path with the first conveyance unit.

The paper sheet conveying apparatus of Item. 5 is the paper sheet conveying apparatus according to any one of Items. 1 to 4, preferably further comprising a paper sheet binding unit configured to bind paper sheets stored in the second storage unit, wherein the control unit binds the paper sheets cut to the predetermined length and stored in the second storage unit with the paper sheet binding unit.

The paper sheet conveying apparatus of Item. 6 is the paper sheet conveying apparatus according to Item. 5, wherein, when a predetermined number of paper sheets cut to the predetermined length are stored in the second storage unit, the control unit preferably binds the paper sheets with the paper sheet binding unit.

The paper sheet conveying apparatus of Item. 7 is the paper sheet conveying apparatus according to Item. 5, wherein the control unit preferably determines whether to bind the paper sheets cut to the predetermined length and stored in the second storage unit in accordance with a switch of settings by a user.

The paper sheet conveying apparatus of Item. 8 is the paper sheet conveying apparatus according to any one of Items. 1 to 7, preferably further comprising: a third storage unit; a third conveyance path used to convey a paper sheet to the third storage unit; a fourth conveyance path provided on a side upstream from the first switching unit in the paper sheet conveyance direction; a second conveyance unit configured to convey a paper sheet along the third conveyance path and the fourth conveyance path; a second switching unit configured to switch a conveyance path of a paper sheet to one of the third conveyance path and the fourth conveyance path; and a second cutting unit provided on a side upstream from the second switching unit in the paper sheet conveyance direction and configured to cut a paper sheet at a cutting position, wherein, when the detecting unit detects a jam in a conveyed paper sheet, the control unit controls the first switching unit, the second switching unit, the first cutting unit, the second cutting unit, the first conveyance unit, and the second conveyance unit such that paper sheets cut to the predetermined length with the first cutting unit and the second cutting unit are stored in the second storage unit, the third storage unit, or both of the second storage unit and the third storage unit.

To achieve the abovementioned object, according to an aspect, an image forming system reflecting one aspect of the present invention comprises: an image forming apparatus configured to form an image on a paper sheet; and a paper sheet conveying apparatus connected to the image forming apparatus, the paper sheet conveying apparatus including: a first storage unit; a second storage unit; a first conveyance path used to convey a paper sheet to the first storage unit; a second conveyance path used to convey a paper sheet to the second storage unit; a conveyance unit configured to convey a paper sheet along the first conveyance path and the second conveyance path; a switching unit configured to switch a conveyance path of a paper sheet to one of the first conveyance path and the second conveyance path; a cutting unit provided on a side upstream from the switching unit in a paper sheet conveyance direction, the cutting unit being configured to cut a paper sheet at a cutting position; a detecting unit configured to detect an occurrence of a jam; and a control unit, when the detecting unit detects a jam in a paper sheet conveyed on the first conveyance path, configured to cut a part of the paper sheet, the part being positioned on a side upstream from the cutting position in the paper sheet conveyance direction, to a predetermined length with the cutting unit, switch a conveyance path of the paper sheet from the first conveyance path to the second conveyance path with the switching unit, and store the paper sheet cut to the predetermined length in the second storage unit through the second conveyance path with the conveyance unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 9 is a flowchart of another exemplary operation of the paper sheet conveying apparatus according to an embodiment;

DESCRIPTION OF THE PREFERRED EMBODIMENTS

Hereinafter, embodiments of a paper sheet conveying apparatus and an image forming system of the present invention will be described with reference to the drawings. However, the scope of the invention is not limited to the illustrated examples.

<Exemplary Configuration of the Paper Sheet Conveying Apparatus of the Present Embodiment>

Figure 1:
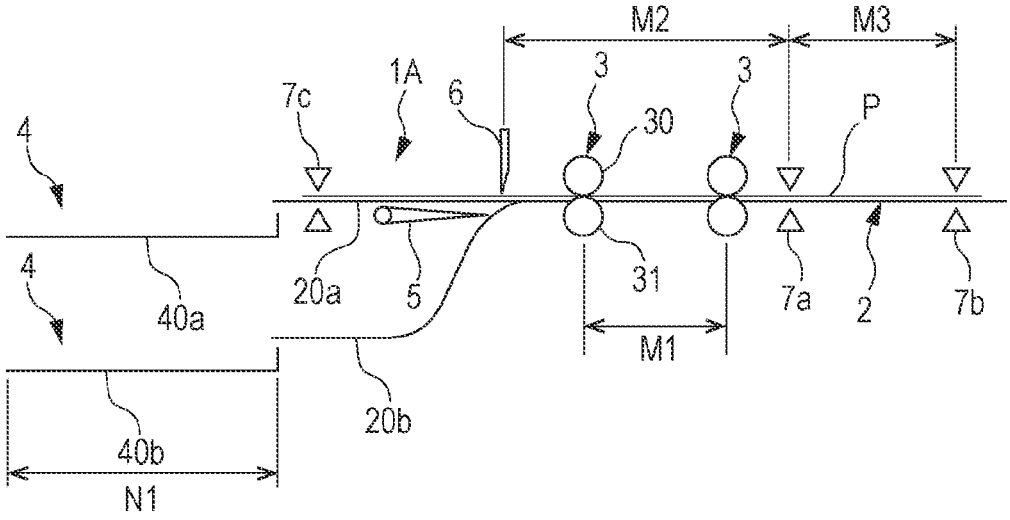
FIG. 1 is a configuration diagram of an exemplary paper sheet conveying apparatus according to an embodiment.

FIG. 1 is a configuration diagram of an exemplary paper sheet conveying apparatus according to the present embodiment. A paper sheet conveying apparatus 1A of the present embodiment includes a conveyance path 2 through which a long paper sheet and a short paper sheet are conveyed. FIG. 1 illustrates a long paper sheet as a paper sheet P. The paper sheet conveying apparatus 1A further includes conveyance rollers 3 configured to convey the paper sheet P on the conveyance path 2, and a plurality of paper discharge units 4 to which the paper sheet P conveyed on the conveyance path 2 is discharged.

The paper sheet conveying apparatus 1A further includes a path switching gate 5 that switches the conveyance route of the paper sheet P to one of the paper discharge units 4, and a cutter 6 that cuts the paper sheet P conveyed on the conveyance path 2. The paper sheet conveying apparatus 1A further includes a the first paper sheet detecting sensor 7*a* and a second paper sheet detecting sensor 7*b* that detect the presence or absence of the paper sheet P conveyed on the conveyance path 2, and a jam detecting sensor 7*c* that detects an occurrence of a jam in the paper sheet P conveyed on each conveyance paths.

Each of the conveyance rollers 3 is an exemplary conveyance unit, and includes a pair of a driving roller 30 and a driven roller 31 that hold the paper sheet P therebetween. Driving the driving roller 30 conveys the paper sheet P. The conveyance path 2 is provided with a plurality of conveyance rollers 3 in a direction in which the paper sheet P is conveyed.

A roller pitch M1 is an interval between the conveyance rollers 3 in the paper sheet conveyance direction. The roller pitch M1 is set at a predetermined length shorter than the conveyance-direction length of the paper sheet having the shortest conveyance-direction length among the paper sheets to be conveyed such that the downstream conveyance roller 3 in the paper sheet conveyance direction can hold the front end of the shortest paper sheet before the rear end of the paper sheet passes through the upstream conveyance roller 3 in the conveyance direction.

In the example of FIG. 1, the paper discharge units 4 include a first storage unit 40*a* and a second storage unit 40*b*, respectively. Each of the first storage unit 40*a* and the second storage unit 40*b* collects and stores a plurality of paper sheets P. Each of the first storage unit 40*a* and the second storage unit 40*b* has a storage length N1 appropriate to the length of the paper sheet to be stored.

The conveyance path 2 branches into a first conveyance path 20*a* used to convey the paper sheet P to the first storage unit 40*a*, and a second conveyance path 20*b* used to convey the paper sheet P to the second storage unit 40*b*. Note that each of the first conveyance path 20*a* and the second conveyance path 20*b* is provided also with conveyance rollers at intervals of predetermined roller pitches.

The path switching gate 5 is an exemplary switching unit and provided at the branch point into the first conveyance path 20*a* and the second conveyance path 20*b* so as to switch the conveyance route of the paper sheet P conveyed on the conveyance path 2 to the first conveyance path 20*a* or the second conveyance path 20*b*. The cutter 6 is an exemplary cutting unit and provided on a side upstream from the path switching gate 5 in the conveyance direction of the paper sheet P.

For example, the cutter 6 cuts a long paper sheet P conveyed from the conveyance path 2 to the first conveyance path 20*a*. This cut enables the paper sheet P remaining on the side upstream from the cutter 6 to be conveyed to the second conveyance path 20*b* after the conveyance route is switched at the path switching gate 5.

When a conveyance jam (hereinafter, referred to as a jam) occurs in a long paper sheet P on the first conveyance path 20*a* while the paper sheet P is conveyed from the conveyance path 2 to the first conveyance path 20*a*, the cutter 6 cuts the paper sheet P so as to separate the paper sheet P into a part in which the jam occurs and a part in which the jam does not occur. One of the separated paper sheets that includes the part in which the jam occurs is referred to as a jam paper sheet and the other sheet that is the part in which the jam does not occur is referred to as a remaining paper sheet.

As described above, by cutting the paper sheet P with the cutter 6, the remaining paper sheet on the side upstream from the cutter 6 can be conveyed to the second conveyance path 20*b* after the path switching gate 5 switches the conveyance route.

Each of the first paper sheet detecting sensor 7*a* and the second paper sheet detecting sensor 7*b* is an exemplary paper sheet detecting unit, and provided at a predetermined position so as to detect a paper sheet P conveyed on the conveyance path 2. Detecting the presence or absence of a paper sheet P with the first paper sheet detecting sensor 7*a* and the second paper sheet detecting sensor 7*b* can calculate the length of the paper sheet P.

In the example of FIG. 1, the first paper sheet detecting sensor 7*a* is provided on the side upstream from the cutter 6 on the conveyance path 2. The second paper sheet detecting sensor 7*b* is provided on the side upstream from the first paper sheet detecting sensor 7*a* on the conveyance path 2. Detecting the presence or absence of the rear end of a paper sheet or a remaining paper sheet separated from the jam paper sheet can calculate the length of such a paper sheet.

The jam detecting sensor 7*c* is an exemplary detecting unit and provided at a predetermined place on the first conveyance path 20*a* in the example of FIG. 1. The jam detecting sensor 7*c* is configured to detect a jam that occurs at the front end of the paper sheet P on the first conveyance path 20*a*. Note that, although not illustrated, the jam detecting sensors 7*c* are provided also at another place on the first conveyance path 20*a*, and predetermined places on the conveyance path 2 and the second conveyance path 20*b*. Alternatively, a sensor for detecting the presence or absence of a paper sheet, such as the first paper sheet detecting sensor 7*a* or the second paper sheet detecting sensor 7*b*, can be used as a jam detecting sensor.

Figure 2:
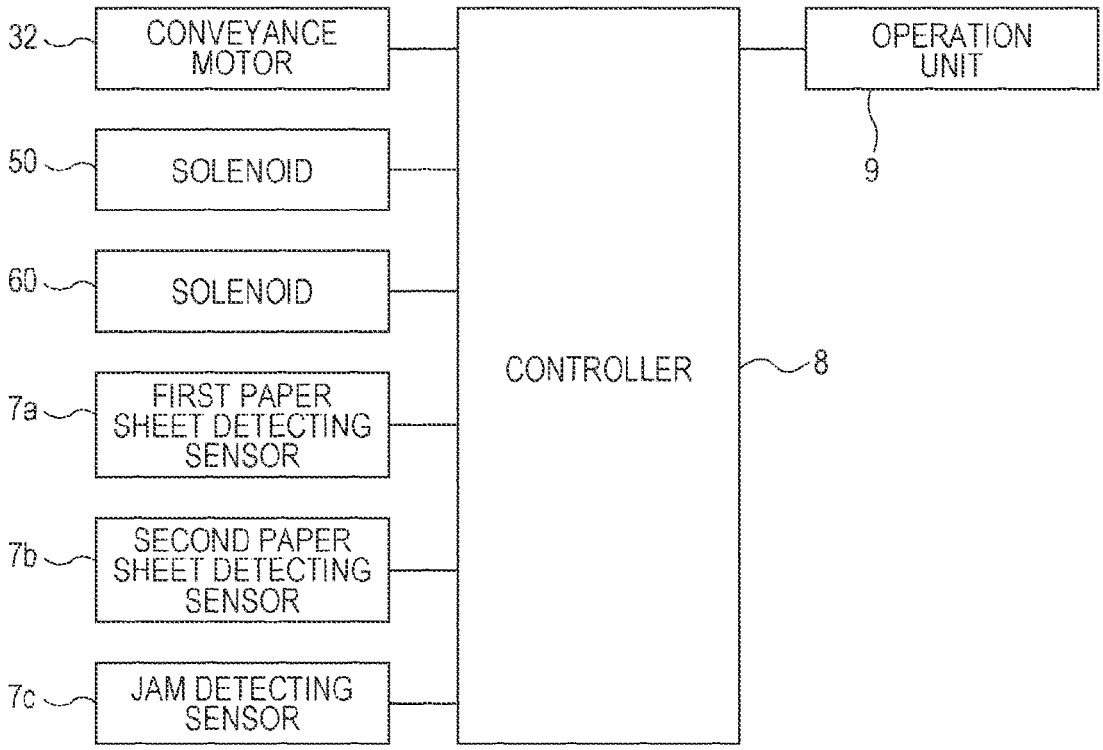
FIG. 2 is a block diagram of an exemplary control function of the paper sheet conveying apparatus according to an embodiment.

FIG. 2 is block diagram of an exemplary control function of the paper sheet conveying apparatus according to the present embodiment. The control function of the paper sheet conveying apparatus 1A is implemented with a conveyance motor 32, a solenoid 50, a solenoid 60, the first paper sheet detecting sensor 7*a*, the second paper sheet detecting sensor 7*b*, the jam detecting sensor 7*c*, and a controller 8.

The conveyance motor 32 drives the driving roller 30 of the conveyance roller 3 illustrated in FIG. 1 and rotates the driving roller 30. This rotation conveys the paper sheet P held between the driving roller 30 and the driven roller 31. The solenoid 50 drives the path switching gate 5 illustrated in FIG. 1 such that the path switching gate 5 switches the conveyance route of the paper sheet P to the first conveyance path 20*a* or the second conveyance path 20*b*. The solenoid 60 drives the cutter 6 such that the cutter 6 cuts the paper sheet P on the conveyance path 2.

The controller 8 is an exemplary control unit and includes a CPU and a memory. The controller 8 makes the CPU execute a program stored in the memory. This execution makes the solenoid 60 drive the cutter 6 to cut the paper sheet P in accordance with the output about the detection of a jam from the jam detecting sensor 7*c*. This separates the paper sheet P into a jam paper sheet and a remaining paper sheet.

Similarly, the controller 8 makes the solenoid 50 drive the path switching gate 5, and makes the conveyance motor 32 drive the conveyance roller 3 to convey the remaining paper sheet without a jam through the conveyance route that is currently available so as to discharge the remaining paper sheet to the paper discharge unit 4.

To store the remaining paper sheet without a jam in the first storage unit 40*a* or the second storage unit 40*b* in the example in FIG. 1, the controller 8 makes the solenoid 60 drive the cutter 6 to cut the remaining paper sheet in accordance with the storage length N1 of the first storage unit 40*a* or the second storage unit 40*b*.

The controller 8 conveys and cuts the remaining paper sheet such that a length L1 of the cut remaining paper sheet satisfies the following expression (1).

$$\text{Roller pitch } M1 \leq \text{Length } L1 \text{ of the cut remaining paper sheet} \leq \text{Storage length } N1 \quad (1)$$

If the length L1 of the cut remaining paper sheet is shorter than the roller pitch M1, the rear end of the remaining paper sheet passes through the upstream conveyance roller 3 in the conveyance direction before the downstream conveyance roller 3 in the conveyance direction holds the front end of the remaining paper sheet. Thus, the length L1 of the cut remaining paper sheet is made longer than the roller pitch M1. If the length L1 of the cut remaining paper sheet is longer than the storage length N1, it may be impossible to store the cut remaining paper sheet in the first storage unit 40*a* or the second storage unit 40*b*. Thus, the length L1 of the cut remaining paper sheet is equal to or shorter than the storage length N1.

The controller 8 determines the amount of a paper sheet or a remaining paper sheet to be conveyed, and whether the remaining paper sheet has been cut in accordance with the detection of the presence or absence of the rear end of the paper sheet before separated, and the presence or absence of the rear end of the separated remaining paper sheet with the first paper sheet detecting sensor 7*a* and the second paper sheet detecting sensor 7*b*. Then, the controller 8 makes the length L1 of the cut remaining paper sheet satisfy the expression (1) so as to convey and store the remaining paper sheet in the first storage unit 40*a* and the second storage unit 40*b*, avoiding the conveyance path on which the jam occurs. Note that the paper sheet conveying apparatus 1A includes an operation unit 9 including a display unit as a notifying unit and is configured to notify, for example, the user of the occurrence of a jam, for example, with visible information. The notifying unit may generate a predetermined sound.

<Exemplary Application of the Paper Sheet Conveying Apparatus of the Present Embodiment>

Figure 3:
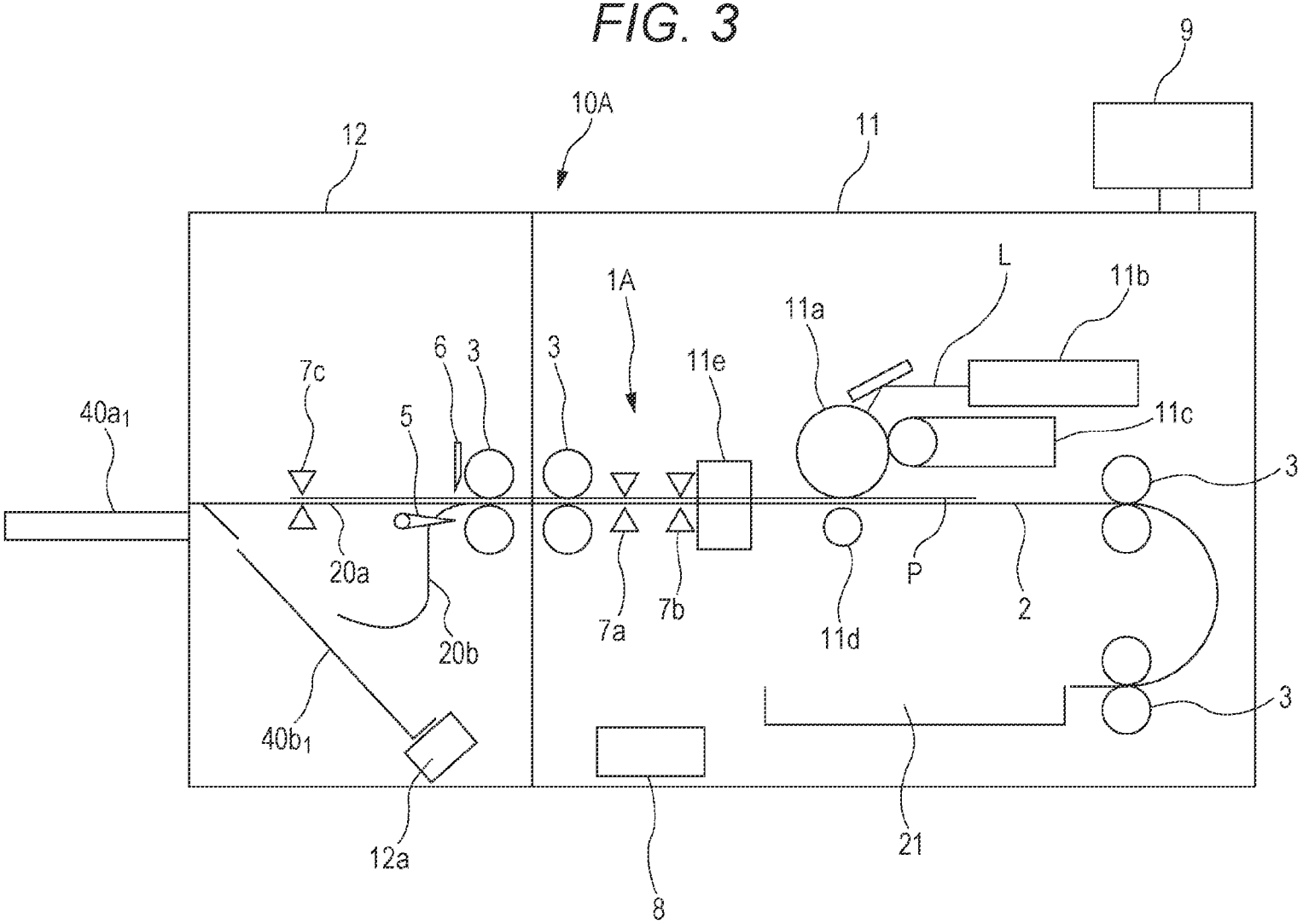
FIG. 3 is a configuration diagram of an exemplary image forming system to which the paper sheet conveying apparatus according to an embodiment is applied.

FIG. 3 is a configuration diagram of an exemplary image forming system to which the paper sheet conveying apparatus according to the present embodiment is applied. An image forming system 10A of the present embodiment includes an image forming apparatus 11, and one or more paper sheet processing apparatuses connected to the image forming apparatus 11. In the example of FIG. 3, a post-processing apparatus 12 that is provided as the paper sheet processing apparatus is connected to the image forming apparatus 11.

The image forming apparatus 11 includes the conveyance path 2 and the conveyance rollers 3 that are included in the paper sheet conveying apparatus 1A illustrated in FIG. 1. This forms a conveyance route through which an image is formed on the paper sheet P. The image forming apparatus 11 includes one or more storage units 21 that store the paper sheet P to be supplied to the conveyance path 2.

The image forming apparatus 11 includes a photoreceptor 11*a* that is an image carrier, an optical device 11*b* that forms an electrostatic latent image by scanning the photoreceptor 11*a* with light, and a developing device 11*c* that forms a toner image by visualizing the electrostatic latent image formed on the photoreceptor 11*a*. The image forming apparatus 11 further includes a transfer unit 11*d* that transfers the toner image formed on the photoreceptor 11*a* to the paper sheet P, and a fixing unit 11*e* that fixes the transferred toner image on the paper sheet P.

The post-processing apparatus 12 has a function for binding paper sheets with a binding needle in the example of FIG. 3. The post-processing apparatus 12 includes a conveyance route which is the first conveyance path 20*a* included in the paper sheet conveying apparatus 1A illustrated in FIG. 1, and on which paper sheets that are not to be bound are conveyed. The post-processing apparatus 12 further includes a conveyance route which is the second conveyance path 20*b* illustrated in FIG. 1, and on which paper sheets that are to be bound are conveyed.

In the image forming system 10A, the connection between the image forming apparatus 11 and the post-processing apparatus 12 connects the conveyance path 2 of the image forming apparatus 11 to the first conveyance path 20*a* and the second conveyance path 20*b* of the post-processing apparatus 12.

The post-processing apparatus 12 includes a main tray $\mathbf{40}a_1$, and a stacker $\mathbf{40}b_1$. The main tray $\mathbf{40}a_1$ corresponds to the first storage unit 40*a* illustrated in FIG. 1, and a paper sheet conveyed on the first conveyance path 20*a* is discharged to the main tray $\mathbf{40}a_1$. The stacker $\mathbf{40}b_1$ corresponds to the second storage unit 40*b* illustrated in FIG. 1, and the paper sheet to be bound are collected on the stacker $\mathbf{40}b_1$. The post-processing apparatus 12 further includes a paper sheet binding unit 12*a* that works as a paper sheet binding unit that binds the paper sheets collected on the stacker $\mathbf{40}b_1$.

Note that the post-processing apparatus 12 includes a conveyance route in which the second conveyance path 20*b* merges with the first conveyance path 20*a* on the side downstream from the stacker $\mathbf{40}b_1$. In a normal state in which a failure such as a jam does not occur, paper sheets bound with the paper sheet binding unit 12*a* are discharged to the main tray $\mathbf{40}a_1$ through the stacker $\mathbf{40}b_1$.

The post-processing apparatus 12 includes the path switching gate 5 at the branch point into the first conveyance path 20*a* and the second conveyance path 20*b*, and the cutter 6 on the side upstream from the path switching gate 5.

The post-processing apparatus 12 switches the conveyance route of a paper sheet to the first conveyance path 20*a* in a mode in which paper sheets on which the image forming apparatus 11 forms an image are not bound and are discharged. Thus, the paper sheets are conveyed through the first conveyance path 20*a* and discharged to the main tray $\mathbf{40}a_1$. The post-processing apparatus 12 switches the conveyance route of a paper sheet to the second conveyance path 20*b* in a staple mode in which a pile of paper sheets are bound. Thus, the pile of paper sheets are collected through the second conveyance path 20*b* on the stacker $\mathbf{40}b_1$, bound with the paper sheet binding unit 12*a*, and discharged through the stacker $\mathbf{40}b_1$ to the main tray $\mathbf{40}a_1$.

<Exemplary Operation of the Paper Sheet Conveying Apparatus of the Present Embodiment>

Figure 4:
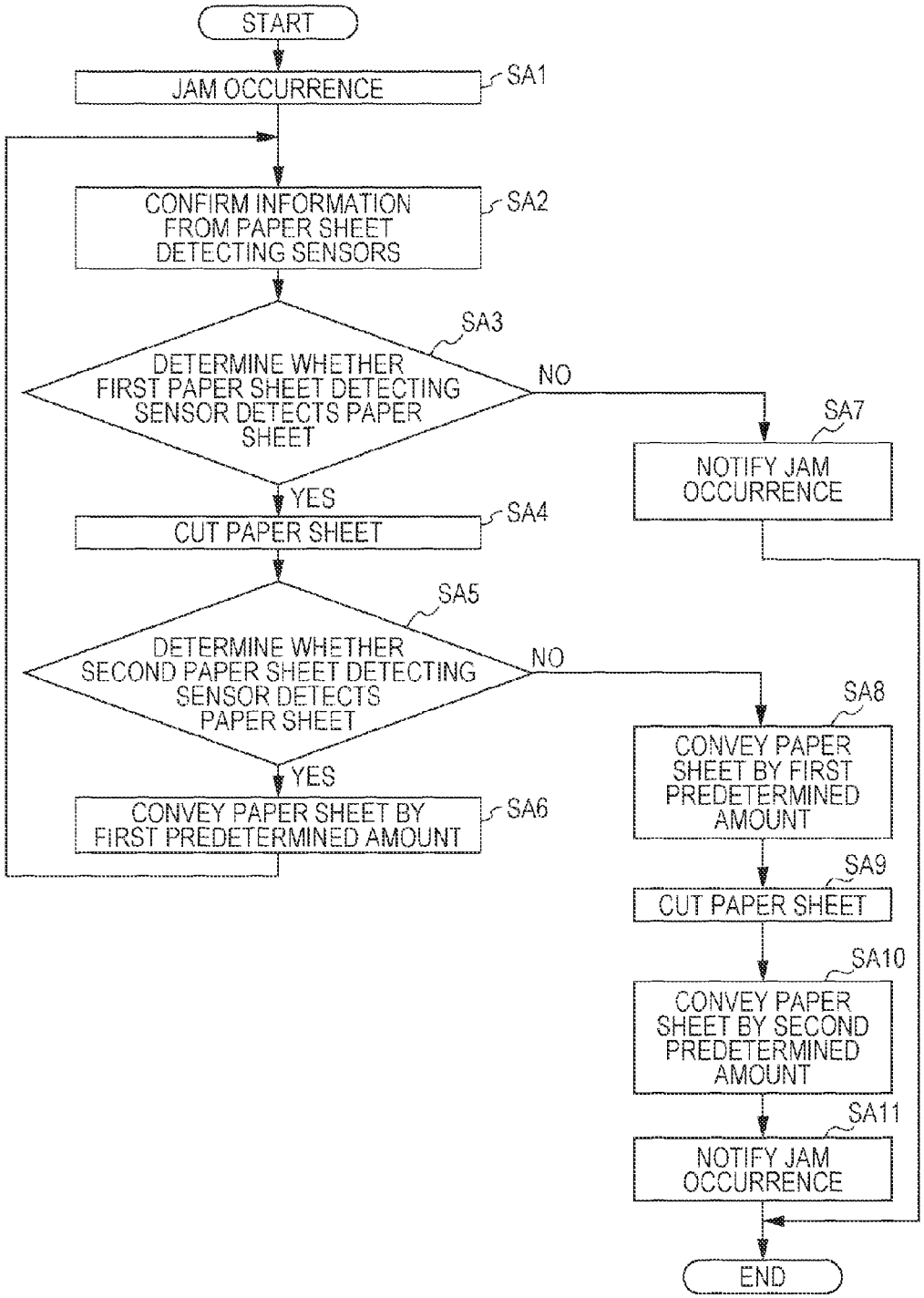
FIG. 4 is a flowchart of an exemplary operation of the paper sheet conveying apparatus according to an embodiment.

FIG. 4 is a flowchart of an exemplary operation of the paper sheet conveying apparatus according to the present embodiment. FIGS. 5A to 8B are explanatory diagrams of the operation of the paper sheet conveying apparatus according to the present embodiment, illustrating the flow of a paper sheet in the paper sheet conveying apparatus. An exemplary operation of the paper sheet conveying apparatus of the present embodiment will be described hereinafter with reference to each of the drawings. The CPU included in the controller 8 executes a program stored in the memory. This execution allows the paper sheet conveying apparatus 1A to perform the process of the flowchart illustrated in FIG. 4.

Herein, on the assumption that the distance between the cutter 6 and the first paper sheet detecting sensor 7*a* is M2 and the distance between the first paper sheet detecting sensor 7*a* and the second paper sheet detecting sensor 7*b* is M3 in the example illustrated in FIG. 1, the first paper sheet detecting sensor 7*a* and the second paper sheet detecting sensor 7*b* are provided at positions at which the following expressions (2) to (4) are satisfied.

$$2 \times M1 < M2 \quad (2)$$

$$M1 < M3 \quad (3)$$

$$2 \times M1 < M2 + M3 < M1 + N1 \quad (4)$$

Figure 5A:
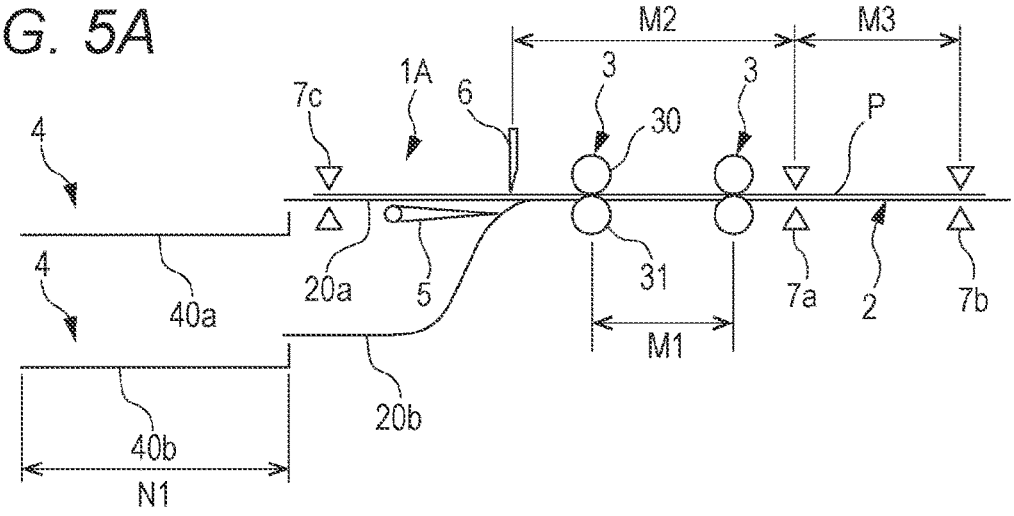
FIGS. 5A to 5C are explanatory diagrams of an operation of the paper sheet conveying apparatus according to an embodiment, illustrating the flow of a paper sheet in the paper sheet conveying apparatus.

The example described below is a case in which a long paper sheet P is conveyed from the conveyance path 2 to the first conveyance path 20*a*, and a jam occurs on the first conveyance path 20*a*. FIGS. 5A to 5C and FIGS. 6A to 6C illustrate an exemplary operation when the rear end of the paper sheet P causing a jam is positioned on the side upstream from the second paper sheet detecting sensor 7*b* as illustrated in FIG. 5A. FIGS. 7A to 7C and FIGS. 8A and 8B illustrate an exemplary operation when the rear end of the paper sheet P causing a jam is positioned between the first paper sheet detecting sensor 7*a* and the second paper sheet detecting sensor 7*b* as illustrated in FIG. 7A.

When detecting that a jam occurs on the first conveyance path 20*a* from the output from the jam detecting sensor 7*c* in step SA1 of FIG. 4, the controller 8 determines the position of the rear end of the paper sheet P from the outputs from the first paper sheet detecting sensor 7*a* and the second paper sheet detecting sensor 7*b* in step SA2.

The controller 8 determines in step SA3 whether the first paper sheet detecting sensor 7*a* detects the paper sheet P. When the first paper sheet detecting sensor 7*a* detects the paper sheet P, the rear end of the paper sheet P has not passed through the position detected with the first paper sheet detecting sensor 7*a*. On the other hand, when the first paper sheet detecting sensor 7*a* does not detect the paper sheet P, the rear end of the paper sheet P has passed through the position detected with the first paper sheet detecting sensor 7*a*.

Figure 5B:
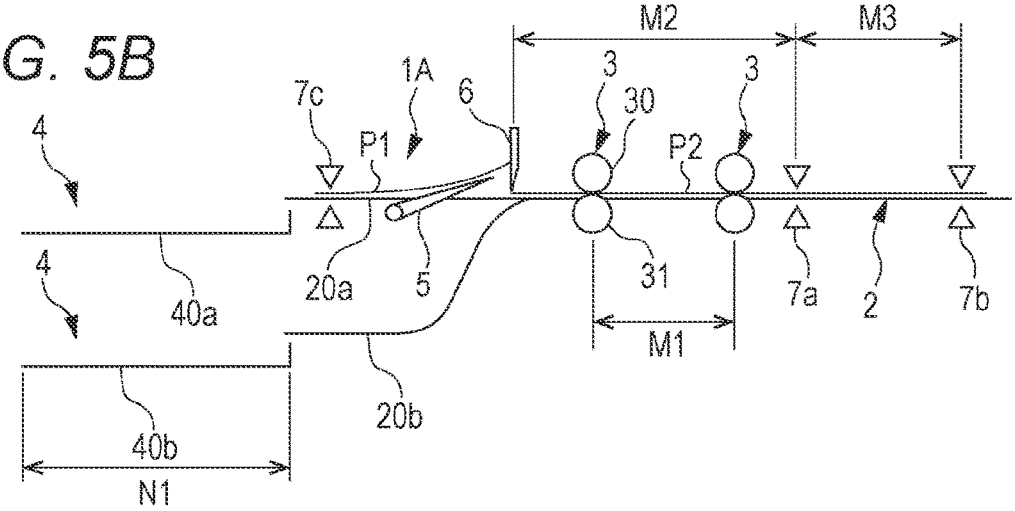
Figure 6A:
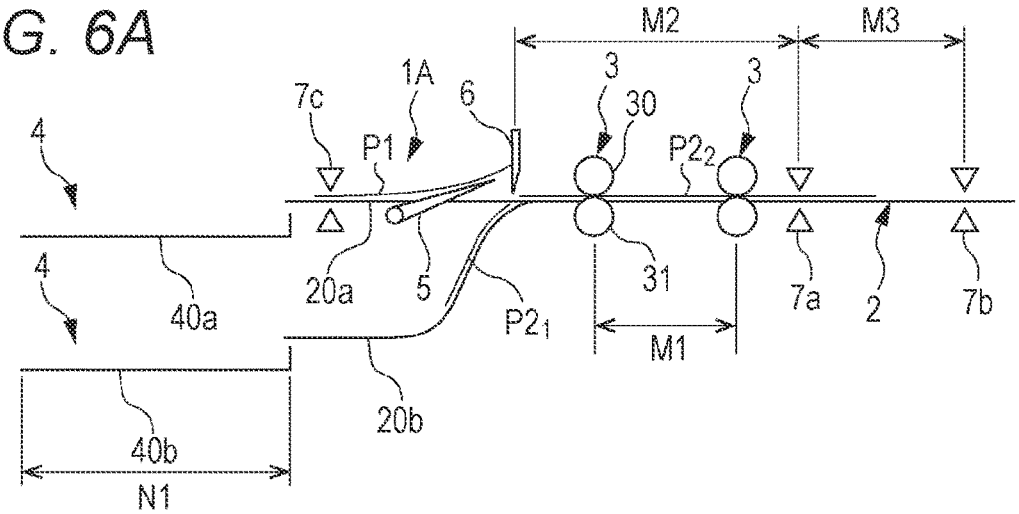
FIGS. 6A to 6C are explanatory diagrams of an operation of the paper sheet conveying apparatus according to an embodiment, illustrating the flow of a paper sheet in the paper sheet conveying apparatus.
Figure 6B:
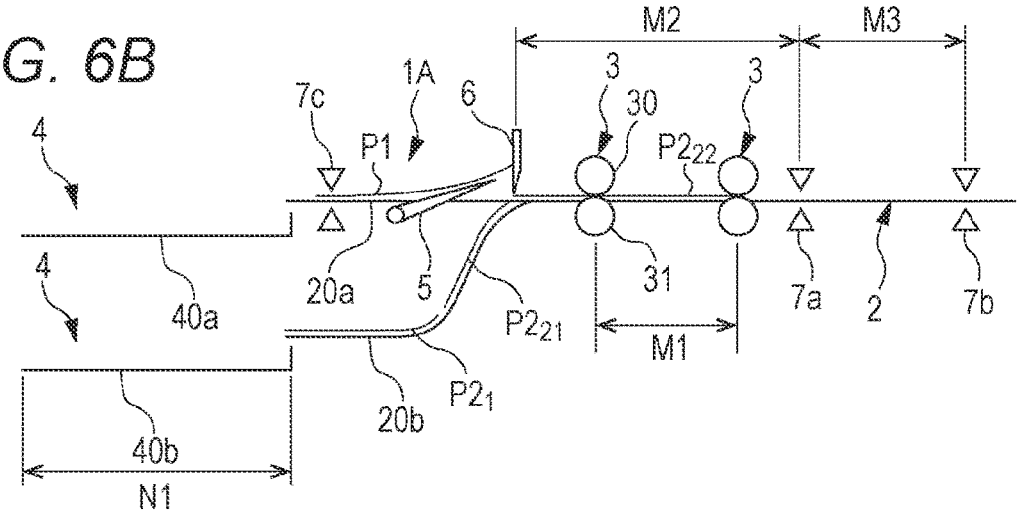
Figure 7A:
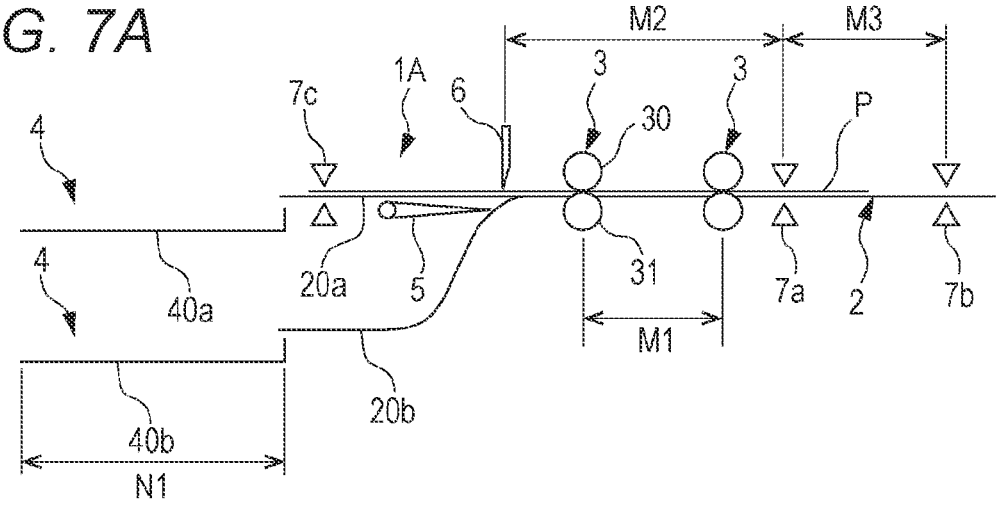
FIGS. 7A to 7C are explanatory diagrams of an operation of the paper sheet conveying apparatus according to an embodiment, illustrating the flow of a paper sheet in the paper sheet conveying apparatus.
Figure 7B:
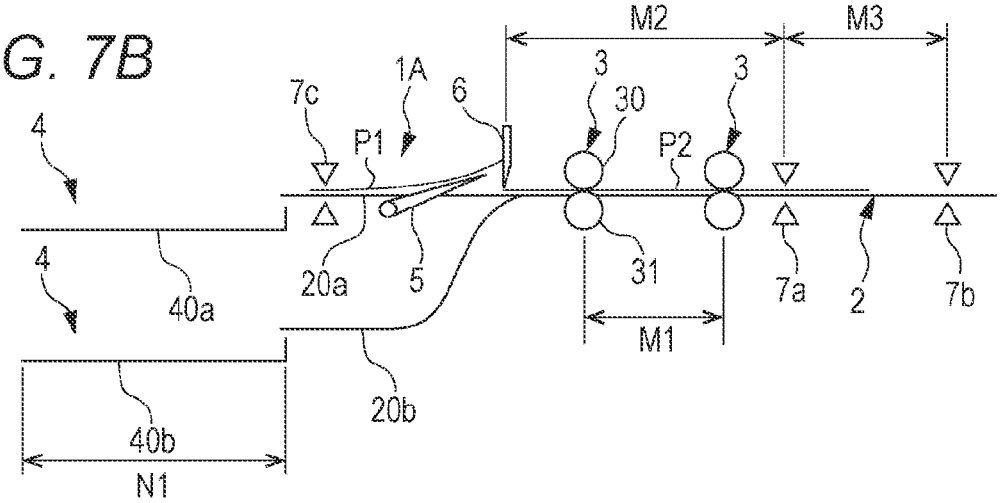

When determining in step SA3 that the first paper sheet detecting sensor 7*a* detects the paper sheet P, the controller 8 cuts the paper sheet P by driving the cutter 6 in step SA4 so as to separate the paper sheet P into the jam paper sheet P1 and the remaining paper sheet P2 as illustrated in FIG. 5B or FIG. 7B.

The controller 8 determines in step SA5 whether the second paper sheet detecting sensor 7*b* detects the remaining paper sheet P2. When the second paper sheet detecting sensor 7*b* detects the remaining paper sheet P2, the rear end of the remaining paper sheet P2 has not passed through the position detected with the second paper sheet detecting sensor 7*b* and is positioned on the upstream side as illustrated in FIG. 5B. On the other hand, when the second paper sheet detecting sensor 7*b* does not detect the remaining paper sheet P2, the rear end of the remaining paper sheet P2 has passed through the position detected with the second paper sheet detecting sensor 7*b* and is positioned between the first paper sheet detecting sensor 7*a* and the second paper sheet detecting sensor 7*b* as illustrated in FIG. 7B.

Figure 5C:
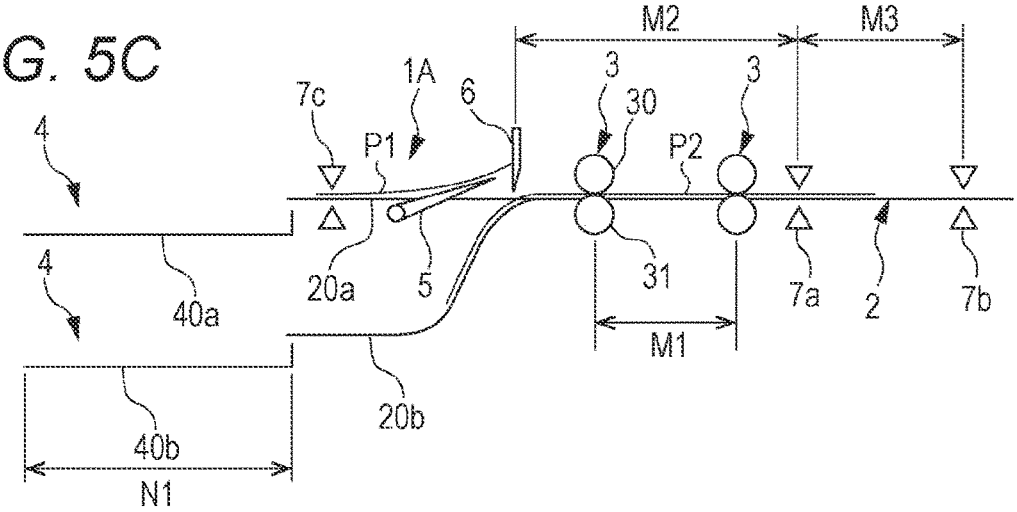

When determining in step SA5 that the second paper sheet detecting sensor 7*b* detects the remaining paper sheet P2, the controller 8 switches the conveyance route to the second conveyance path 20*b* with the path switching gate 5 and conveys the remaining paper sheet P2 by a first predetermined amount that corresponds to the roller pitch M1 in step SA6 as illustrated in FIG. 5C. Then, the process goes to step SA2.

When determining in step SA3 that the first paper sheet detecting sensor 7*a* does not detect the paper sheet P, the controller 8 notifies the user or a maintenance operator of the occurrence of the jam, for example, with the display unit of the operation unit 9 so as to enable the user or the maintenance operator to remove the jam paper sheet P1 remaining on the first conveyance path 20*a* in step SA7.

The next example will be described below. In the example, it is determined in step SA5 that the rear end of the remaining paper sheet P2 is positioned on the side upstream from the second paper sheet detecting sensor 7*b* when a jam occurs. The remaining paper sheet P2 is conveyed by the first predetermined amount that corresponds to the roller pitch M1 in the process of step SA6. After that, as illustrated in FIG. 5C, the rear end of the remaining paper sheet P2 has passed through the second paper sheet detecting sensor 7*b*, but has not passed through the first paper sheet detecting sensor 7*a*.

In such a state, it is determined in step SA3 that the first paper sheet detecting sensor 7*a* detects the paper sheet P. The controller 8 cuts the remaining paper sheet P2 by driving the cutter 6 in step SA4 so as to separate the remaining paper sheet P2 into a preceding remaining paper sheet $P2_1$ and a subsequent remaining paper sheet $P2_2$ as illustrated in FIG. 6A.

When determining in step SA5 that the second paper sheet detecting sensor 7*b* does not detect the paper sheet P, the controller 8 conveys each of the remaining paper sheet $P2_1$ and the remaining paper sheet $P2_2$ by the first predetermined amount corresponding to the roller pitch M1 in step SA8. In step SA9, the controller 8 cuts the remaining paper sheet $P2_2$ to a length short enough to be stored in the second storage unit 40*b* by driving the cutter 6 as illustrated in FIG. 6B. Thus, the remaining paper sheet $P2_2$ is separated into a remaining paper sheet $P2_{21}$ and a remaining paper sheet $P2_{22}$.

Figure 6C:
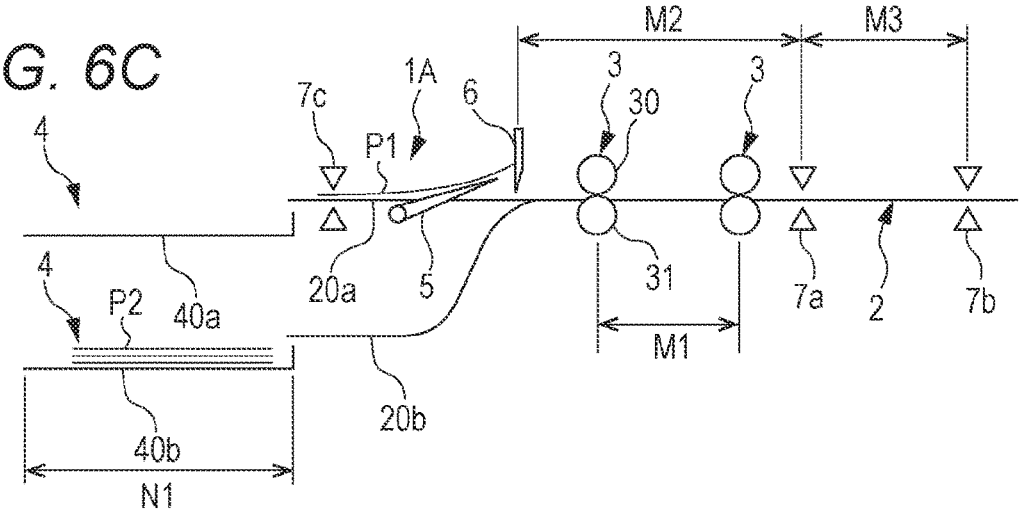

Then, in step SA10, the controller 8 conveys the remaining paper sheet by a second predetermined amount that exceeds the amount corresponding to the storage length N1, and stores the separated remaining paper sheets P2 in the second storage unit 40*b* as illustrated in FIG. 6C. After that, in step SA11, the controller 8 notifies the user or a maintenance operator of the occurrence of the jam, for example, with the display unit of the operation unit 9 so as to enable the user or the maintenance operator to remove the jam paper sheet P1 remaining on the first conveyance path 20*a*.

The next example will be described below. In the example, it is determined in step SA5 that the rear end of the remaining paper sheet P2 is positioned between the first paper sheet detecting sensor 7*a* and the second paper sheet detecting sensor 7*b* as illustrated in FIG. 7B when a jam occurs.

Figure 7C:
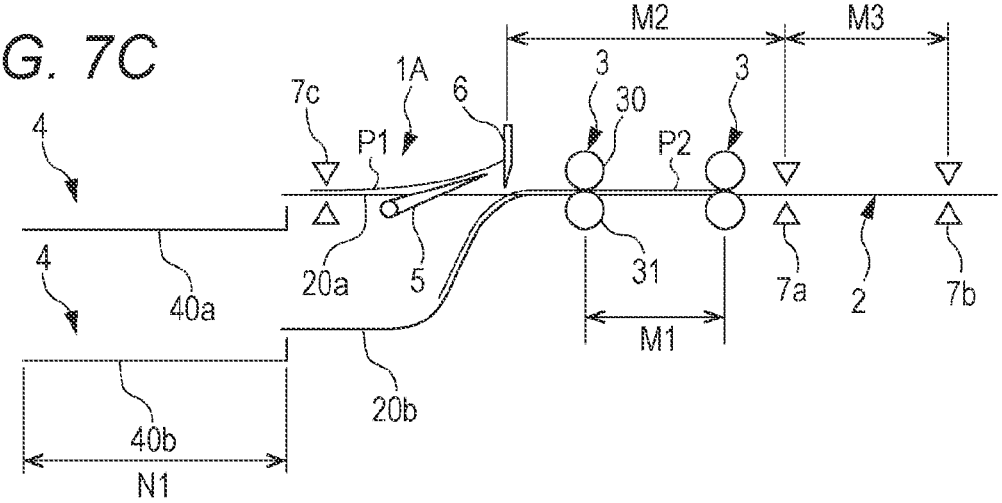
Figure 8A:
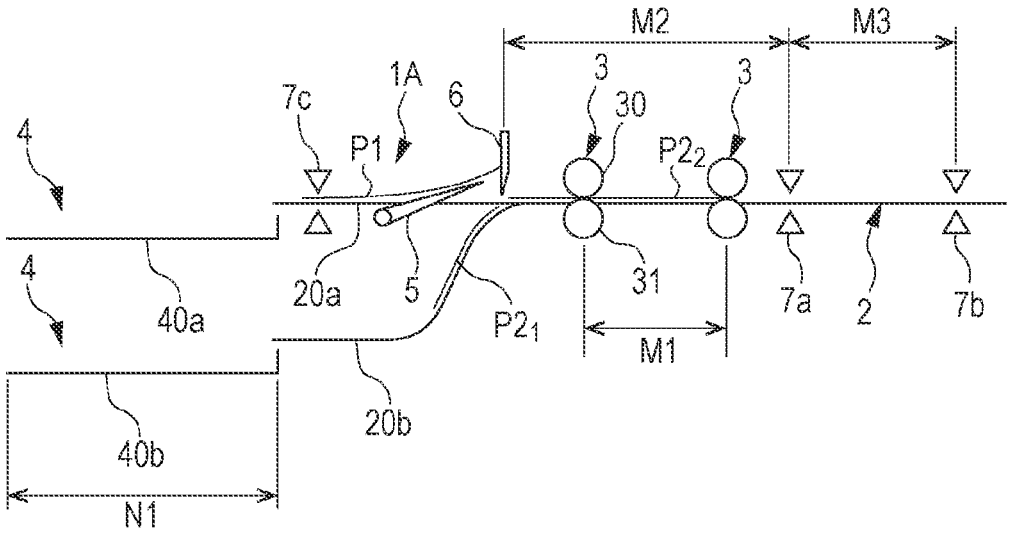
FIGS. 8A and 8B are explanatory diagrams of an operation of the paper sheet conveying apparatus according to an embodiment, illustrating the flow of a paper sheet in the paper sheet conveying apparatus.

When determining in step SA5 that the second paper sheet detecting sensor 7*b* does not detect the remaining paper sheet P2, the controller 8 switches the conveyance route to the second conveyance path 20*b* with the path switching gate 5 so as to convey the remaining paper sheet P2 by the first predetermined amount that corresponds to the roller pitch M1 in step SA8 as illustrated in FIG. 7C. In step SA9, the controller 8 cuts the remaining paper sheet P2 to a length short enough to be stored in the second storage unit 40*b* by driving the cutter 6 as illustrated in FIG. 8A. Thus, the remaining paper sheet P2 is separated into the remaining paper sheet $P2_1$ and the remaining paper sheet $P2_2$.

Figure 8B:
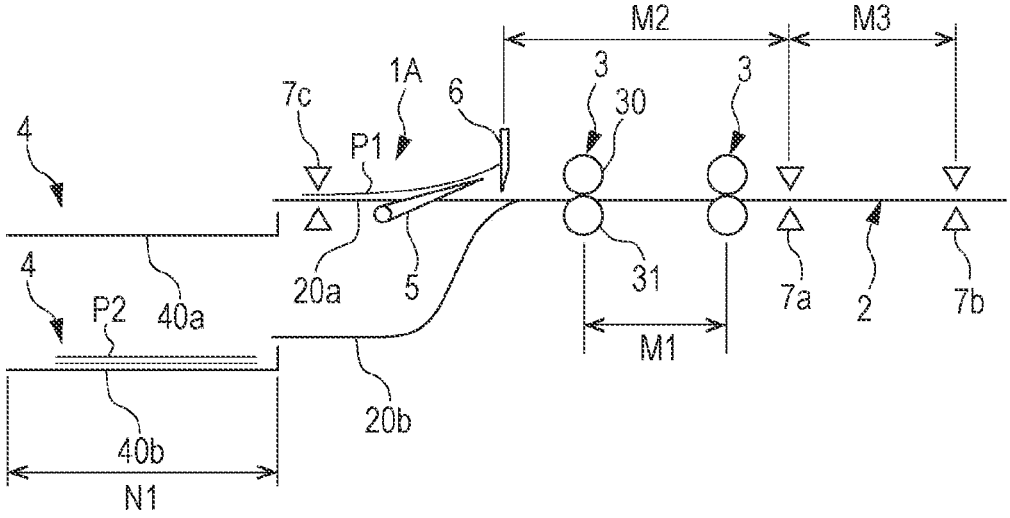

Then, the controller 8 conveys the remaining paper sheet by a second predetermined amount that exceeds the amount corresponding to the storage length N1, and stores the separated remaining paper sheets P2 in the second storage unit 40*b* as illustrated in FIG. 8B in step SA10. After that, the controller 8 notifies the user or a maintenance operator of the occurrence of the jam, for example, with the display unit of the operation unit 9 so as to enable the user or the maintenance operator to remove the jam paper sheet P1 remaining on the first conveyance path 20*a* in step SA11.

The jam paper sheet P1 separated from the remaining paper sheet P2 with the cutter 6 is short in length, and thus is easily removed, for example, by the conveyance by hand. The separation also prevents the jam paper sheet P1 from extending over a plurality of racks. Thus, the jam paper sheet P1 can easily be removed even in a manner in which the rack provided with the conveyance path is drawn to remove the jam paper sheet P1.

The image forming system 10A with the paper sheet conveying apparatus 1A illustrated in FIG. 3 separates a paper sheet into a jam paper sheet and a remaining paper sheet when a jam occurs. Thus, even when conveying a paper sheet long enough to extend over the image forming apparatus 11 and the post-processing apparatus 12, the image forming system 10A enables the user to easily remove the jam paper sheet by manually conveying the jam paper sheet and drawing the rack.

The remaining paper sheet P2 does not exist on the conveyance path. This enables the user to remove the jam paper sheet by manually conveying the jam paper sheet to the image forming apparatus 11 or the post-processing apparatus 12 depending on the place in which the jam occurs and drawing a predetermined rack.

As described above, when the second paper sheet detecting sensor 7*b* does not detect the remaining paper sheet P2 separated from the jam paper sheet P1 in step SA5, the rear end of the remaining paper sheet P2 is positioned between the first paper sheet detecting sensor 7*a* and the second paper sheet detecting sensor 7*b*.

In such a state, a length L2 of the remaining paper sheet $P2_2$ illustrated in FIG. 6A or the remaining paper sheet P2 illustrated in FIG. 7B is longer than twice the roller pitch M1, shorter than the sum of the roller pitch M1 and the storage length N1, and thus satisfies the relationship of $2 \times M1 < L2 < M1 + N1$. In this case, the procedures in step SA8 to step SA11 are performed as described above.

The remaining paper sheet is conveyed by the first predetermined amount that corresponds to the roller pitch M1 in step SA8. This makes a length L3 of the remaining paper sheet $P2_{22}$ cut in step SA4 and illustrated in FIG. 6B or of the remaining paper sheet $P2_2$ illustrated in FIG. 8A longer than the roller pitch M1, shorter than the storage length N1, and thus satisfies $M1 < L3 < N1$. Accordingly, conveying the remaining paper sheet by the second predetermined amount that exceeds the amount corresponding to the storage length N1 in step SA10 can store all of the separated remaining paper sheets in the second storage unit 40*b*.

On the other hand, when the first paper sheet detecting sensor 7*a* detects the paper sheet P in step SA3 described above and the second paper sheet detecting sensor 7*b* detects the paper sheet P in step SA5, the rear end of the paper sheet P is positioned on the side upstream from the second paper sheet detecting sensor 7*b*.

The expression (3) prescribes that the distance M3 between the first paper sheet detecting sensor 7*a* and the second paper sheet detecting sensor 7*b* is longer than the roller pitch M1. As a result, even when the remaining paper sheet P2 is conveyed by the first predetermined amount that corresponds to the roller pitch M1 in step SA6, the rear end of the remaining paper sheet P2 is positioned between the first paper sheet detecting sensor 7*a* and the second paper sheet detecting sensor 7*b*, or does not reach the second paper sheet detecting sensor 7*b*. This means that the rear end of the remaining paper sheet P2 is not conveyed between the cutter 6 and the first paper sheet detecting sensor 7*a*.

Thus, the procedures in step SA2 to step SA6 are repeated until the first paper sheet detecting sensor 7*a* detects the remaining paper sheet P2 in step SA3 described above and the second paper sheet detecting sensor 7*b* does not detect the remaining paper sheet P2 in step SA5, so that the remaining paper sheet P2 is cut in accordance with the length of the roller pitch M1 and is conveyed. After that, the procedures in step SA8 to step SA11 are performed and thus the separated remaining paper sheets P2 can be stored in the second storage unit 40*b*.

The image forming system 10A with the paper sheet conveying apparatus 1A illustrated in FIG. 3 can bind the remaining paper sheets P2 stored in the stacker $\mathbf{40}b_1$ that is the second storage unit 40*b*, using the paper sheet binding unit 12*a*. When the remaining paper sheet P2 separated into a length short enough to be stored in the stacker $\mathbf{40}b_1$ in the procedures described above are collected and stored in the stacker $\mathbf{40}b_1$, the paper sheet binding unit 12*a* binds a pile of the remaining paper sheets P2 and the bound remaining paper sheets P2 are discharged. This can facilitate a process for collecting a plurality of remaining paper sheets P2.

The number of paper sheets to be bound with the paper sheet binding unit 12*a* is predetermined, for example, in accordance with the type of paper, or the basis weight. In terms of the foregoing, when the number of remaining paper sheets stored in the stacker $\mathbf{40}b_1$ reaches the predetermined number of paper sheets to be bound, the paper sheets may be bound and discharged. This enables the image forming system 10A to discharge the remaining paper sheets by binding the remaining paper sheets by the predetermined number even when the number of remaining paper sheets is larger than the number of paper sheets to be bound with the paper sheet binding unit 12*a*. For example, a maintenance operator can determine whether to perform the binding process by operating the operation unit 9 and configuring the settings. When the maintenance operator operates the operation unit 9 to configure the setting for performing a binding process, the binding process is performed as described above. On the other hand, when the maintenance operator operates the operation unit 9 to configure the setting not to perform a binding process, the binding process is not performed.

FIG. 9 is a flowchart of another exemplary operation of the paper sheet conveying apparatus according to the present embodiment. In the operation of FIG. 4 described above, the paper sheet P is separated into the jam paper sheet P1 and the remaining paper sheet P2 and the remaining paper sheets P2 are stored in the storage unit. After that, the occurrence of the jam is notified such that the process for the jam paper sheet, such as the removal of the jam paper sheet, is performed. On the other hand, in the operation of FIG. 9, the paper sheet P is separated into the jam paper sheet P1 and the remaining paper sheet P2. Then, the remaining paper sheets P2 are stored in the storage unit after the completion of the process for the jam paper sheet P1. In the paper sheet conveying apparatus 1A, the CPU included in the controller 8 executes a program stored in the memory. This execution implements the process described in the flowchart in FIG. 9.

When detecting in step SB1 of FIG. 9 that a jam occurs, the controller 8 determines the position of the rear end of the paper sheet P from the outputs from the first paper sheet detecting sensor 7*a* and the second paper sheet detecting sensor 7*b* in step SB2.

The controller 8 determines in step SB3 whether the first paper sheet detecting sensor 7*a* detects the paper sheet P. When determining in step SB3 that the first paper sheet detecting sensor 7*a* detects the paper sheet P, the controller 8 cuts the paper sheet P by driving the cutter 6 so as to separate the paper sheet into the jam paper sheet P1 and the remaining paper sheet P2 in step SB4.

After separating the paper sheet P causing the jam into the jam paper sheet P1 and the remaining paper sheet P2, the controller 8 notifies the occurrence of the jam, for example, using the display unit of the operation unit 9 in step SB5. Once receiving the notification of the occurrence of the jam, the maintenance operator or someone completes the process for the jam paper sheet P1, for example, the removal of the jam paper sheet in step SB6.

After the completion of the process for the jam paper sheet P1, the controller 8 determines the position of the rear end of the remaining paper sheet P2 from the outputs from the first paper sheet detecting sensor 7*a* and the second paper sheet detecting sensor 7*b* in step SB7. The controller 8 determines in step SB8 whether the first paper sheet detecting sensor 7*a* detects the remaining paper sheet P2.

When determining in step SB8 that the first paper sheet detecting sensor 7*a* detects the remaining paper sheet P2, the controller 8 determines in step SB9 whether the second paper sheet detecting sensor 7*b* detects the remaining paper sheet P2. When determining in step SB9 that the second paper sheet detecting sensor 7*b* detects the remaining paper sheet P2, the controller 8 switches the conveyance route to the second conveyance path 20*b* with the path switching gate 5 so as to convey the remaining paper sheet P2 by the first predetermined amount that corresponds to the roller pitch M1 in step SB10.

After conveying the remaining paper sheet P2 by the first predetermined amount that corresponds to the roller pitch M1 in step SB10, the controller 8 cuts the remaining paper sheet P2 by driving the cutter 6 in step SB11. Then, the process goes back to step SB7.

When determining in step SB3 that the first paper sheet detecting sensor 7*a* does not detect the remaining paper sheet P2, the controller 8 notifies the occurrence of the jam in step SB12.

When determining in step SB9 that the second paper sheet detecting sensor 7*b* does not detect the remaining paper sheet P2, the controller 8 switches the conveyance route to the second conveyance path 20*b* with the path switching gate 5 so as to convey the remaining paper sheet P2 by the first predetermined amount that corresponds to the roller pitch M1 in step SB13. The controller 8 cuts the remaining paper sheet P2 by driving the cutter 6 in step SB14.

Then, the controller 8 conveys the remaining paper sheet P2 by the second predetermined amount that exceeds the amount corresponding to the storage length N1, and stores the remaining paper sheet P2 in the second storage unit 40*b* in step SB15. The remaining paper sheet P2 is stored in the second storage unit 40*b* by the procedures in step SB13 to step SB15. Accordingly, no paper sheet remains on the conveyance path 2, the first conveyance path 20*a*, and the second conveyance path 20*b*. Then, the process, for example, for conveying a paper sheet is restarted in step SB16. When it is determined in step SB8 that the second paper sheet detecting sensor 7*b* does not detect the remaining paper sheet P2, no paper sheet remains on the conveyance path 2, the first conveyance path 20*a*, and the second conveyance path 20*b*. Thus, the process, for example, for conveying a paper sheet is restarted in step SB16.

<Exemplary Variation of the Paper Sheet Conveying Apparatus of the Present Embodiment>

Figure 10:
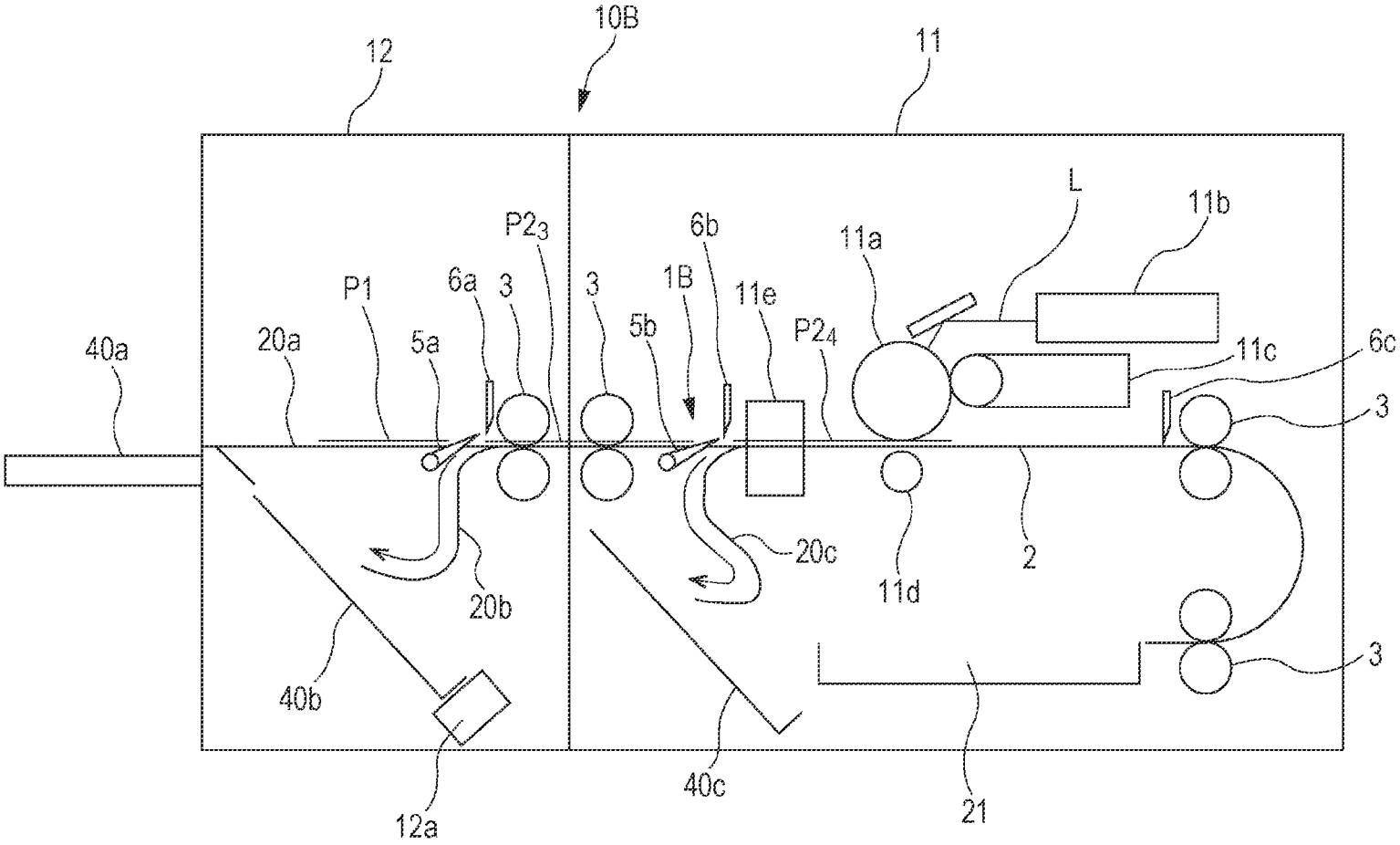
FIG. 10 is a configuration diagram of an exemplary variation of the image forming system to which the paper sheet conveying apparatus according to an embodiment is applied.
Figure 11:
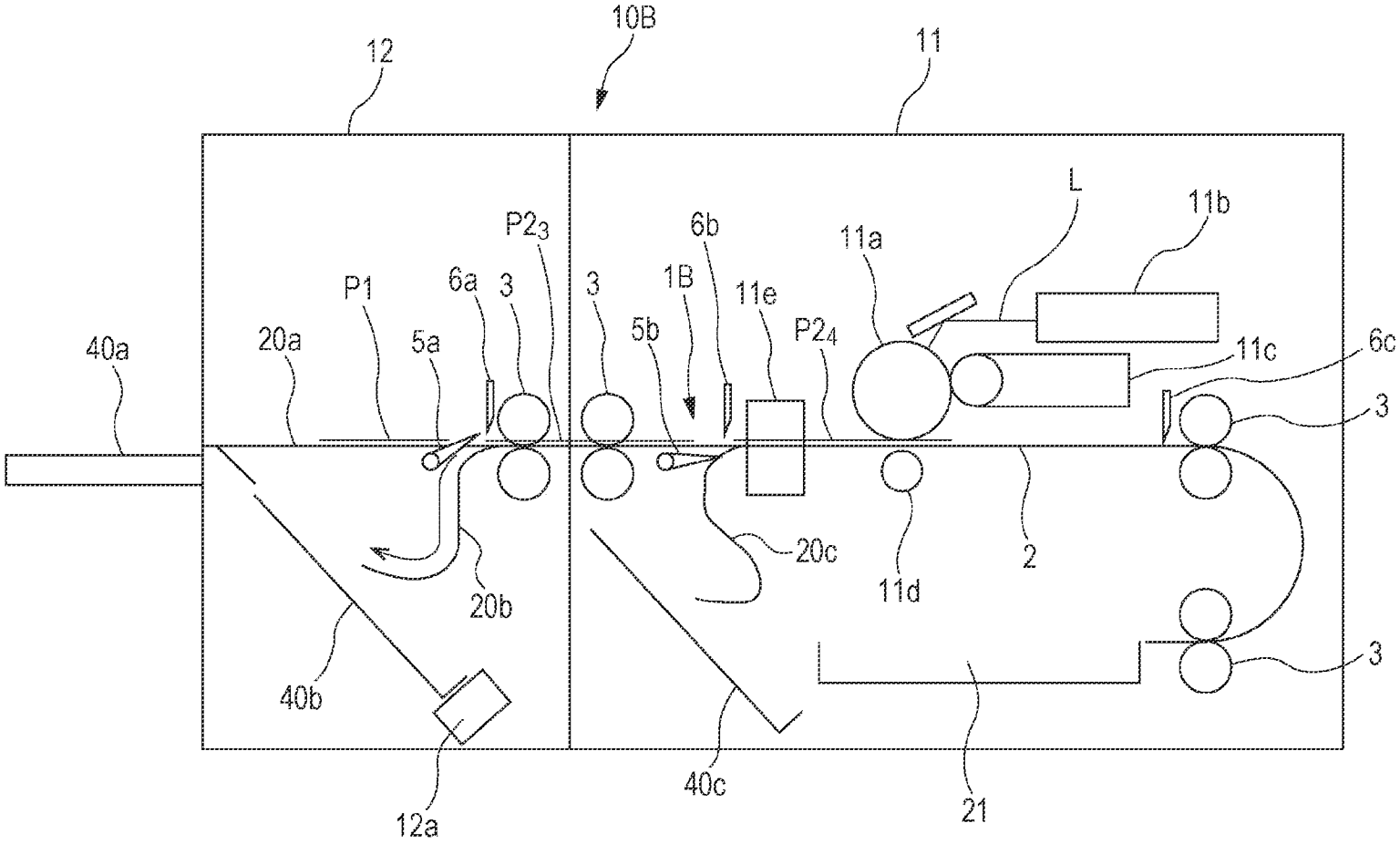
FIG. 11 is a configuration diagram of an exemplary variation of the image forming system to which the paper sheet conveying apparatus according to an embodiment is applied.

FIGS. 10 and 11 are configuration diagrams of exemplary variations of the image forming system to which the paper sheet conveying apparatus according to the present embodiment is applied. Note that the same components as those described, for example, with reference to FIGS. 1 and 3 are put with the same reference signs and the descriptions are omitted.

An image forming system 10B with a paper sheet conveying apparatus 1B includes an image forming apparatus 11, and one or more paper sheet processing apparatuses connected to the image forming apparatus 11. In the examples of FIGS. 10 and 11, a post-processing apparatus 12 that is provided as the paper sheet processing apparatus is connected to the image forming apparatus 11.

The paper sheet conveying apparatus 1B includes a plurality of cutters on a conveyance path 2. Three cutters 6*a* to 6*c* are provided on the conveyance path 2 in the present examples. In the examples of FIGS. 10 and 11, the post-processing apparatus 12 is provided with the cutter 6*a* at the branch point into a first conveyance path 20*a* and a second conveyance path 20*b* such that the conveyance route of a paper sheet cut with the cutter 6*a* is switched to the first conveyance path 20*a* or the second conveyance path 20*b* with a path switching gate 5*a*.

In the image forming apparatus 11, a paper sheet conveying apparatus 1B includes a third conveyance path 20*c* that is a branch from the conveyance path 2, and a third storage unit 40*c* in which a paper sheet conveyed through the third conveyance path 20*c* is stored. The cutter 6*b* that is an example of another cutting unit is provided at the branch point into the conveyance path 2 that is an example of a fourth conveyance path and the third conveyance path 20*c* such that the conveyance route of the paper sheet cut with the cutter 6*b* is switched to the conveyance path 2 and the third conveyance path 20*c* with the path switching gate 5*b* that is an example of another switching unit. Furthermore, the cutter 6*c* that is an example of another cutting unit may be provided on the side upstream from the cutter 6*b*.

Each of the intervals among the cutters 6*a* to 6*c* is made longer than the roller pitch of the conveyance rollers 3. This is because an interval between the cutters made shorter than the roller pitch hinders the conveyance of the paper sheet cut between the cutters. Additionally, each of the positions to provide the cutters is preferably near the path switching gate and on the side upstream from the path switching gate.

When a paper sheet P long enough to extend over the post-processing apparatus 12 and the image forming apparatus 11 is conveyed, and a jam occurs on the side of the front end of the paper sheet P, the cutters 6*a* to 6*c* cut the remaining paper sheet. When there is a conveyance path just near each of the cutters 6*a* and 6*b* as the example of FIG. 10, the conveyance route of each of the cut remaining paper sheets is switched to each conveyance path such that each of the cut remaining paper sheets is stored in the storage unit.

In the example of FIG. 10, when a remaining paper sheet $P2_3$ is cut with the cutter 6*a* and the cutter 6*b*, the conveyance route is switched to the second conveyance path 20*b* with the path switching gate 5*a*. Then, the remaining paper sheet $P2_3$ is conveyed through the second conveyance path 20*b* and stored in the second storage unit 40*b*. When a remaining paper sheet $P2_4$ is cut with the cutter 6*b*, the conveyance route is switched to the third conveyance path 20*c* with the path switching gate 5*b*. Then, the remaining paper sheet $P2_4$ is conveyed through the third conveyance path 20*c* and stored in the third storage unit 40*c*.

Thus, the jam paper sheet P1 remains on the first conveyance path 20*a* without extending over the post-processing apparatus 12 and the image forming apparatus 11, and thus can easily be removed. Furthermore, the remaining paper sheet can be stored in the storage unit though a short conveyance distance without extending over the post-processing apparatus 12 and the image forming apparatus 11.

In the example of FIG. 11, the remaining paper sheets cut with the cutters 6*a* to 6*c* are stored in the same storage unit. For example, when a remaining paper sheet $P2_3$ is cut with the cutter 6*a* and the cutter 6*b*, the conveyance route is switched to the second conveyance path 20*b* with the path switching gate 5*a*. Then, the remaining paper sheet $P2_3$ is conveyed through the second conveyance path 20*b* and stored in the second storage unit 40*b*. When a remaining paper sheet $P2_4$ is cut with the cutter 6*b*, the conveyance route is switched to the conveyance path 2 with the path switching gate 5*b*, and further switched to the second conveyance path 20*b* with the path switching gate 5*a*. Then, the remaining paper sheet $P2_4$ is conveyed through the second conveyance path 20*b* and stored in the second storage unit 40*b*.

Thus, the jam paper sheet P1 remains on the first conveyance path 20*a* without extending over the post-processing apparatus 12 and the image forming apparatus 11, and thus can easily be removed. Furthermore, the remaining paper sheets can be stored in the same storage unit without extending over the post-processing apparatus 12 and the image forming apparatus 11.

The examples in which a jam occurs on the side of the front end of a long paper sheet have been described in the embodiments. Note that, however, even when a jam occurs on the side of the rear end of the paper sheet, it is determined, for example, how the paper sheet stops, or the length of the paper sheet in accordance with the information about the presence or absence of the paper sheet detected by a plurality of paper sheet detecting sensors. Subsequently, the paper sheet is conveyed and cut with the cutter. Thus, a remaining paper sheet separated from the jam paper sheet can be stored in the storage unit.

The present embodiments are applied to an apparatus including a conveyance route on which a long paper sheet is conveyed.

According to an embodiment of the present invention, if a jam is detected in a paper sheet conveyed on the first conveyance path, the paper sheet is separated into a part causing the jam and a part without the jam. Subsequently, the conveyance path of the part without the jam is switched to the second conveyance path. Meanwhile, the paper sheet is cut to a predetermined length and stored in the second storage unit through the second conveyance path.

Thus, even if the conveyed paper sheet is a long paper sheet, the part causing the jam is shortened, and thus can easily be removed. The part without the jam is cut to a predetermined length and stored in the storage unit, and thus does not need, for example, to manually be removed. Thus, the process, for example, for conveying the paper sheet can promptly be resumed.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A paper sheet conveying apparatus comprising:

a first storage unit;

a second storage unit;

a first conveyance path used to convey a paper sheet to the first storage unit;

a second conveyance path used to convey the paper sheet to the second storage unit;

a first conveyance unit configured to convey the paper sheet along the first conveyance path and the second conveyance path;

a first switching unit configured to switch a conveyance path of the paper sheet to one of the first conveyance path and the second conveyance path;

a first cutting unit provided on a side upstream from the first switching unit in a paper sheet conveyance direction, the first cutting unit being configured to cut the paper sheet at a cutting position;

a detecting unit configured to detect an occurrence of a jam; and a control unit, when the detecting unit detects a jam in the paper sheet conveyed on the first conveyance path, configured to cut the paper sheet, with the first cutting unit, into a first part in which the jam occurs and a second part in which the jam does not occur, the second part being positioned on a side upstream from the cutting position in the paper sheet conveyance direction, switch the conveyance path of the paper sheet from the first conveyance path to the second conveyance path with the first switching unit, and convey the second part of the paper sheet to the second storage unit through the second conveyance path with the first conveyance unit while the first part of the paper sheet remains on the first conveyance path.

2. The paper sheet conveying apparatus according to claim 1, wherein the control unit controls the first conveyance unit and the first cutting unit such that a predetermined length of the second part of the paper sheet to be cut with the first cutting unit is equal to or longer than a length long enough to be conveyed with the first conveyance unit, and equal to or shorter than a length short enough to be stored in the second storage unit.

3. The paper sheet conveying apparatus according to claim 1, further comprising:

a notifying unit configured to notify a user of an occurrence of a jam, wherein the control unit notifies an occurrence of a jam with the notifying unit after the second part positioned on the side upstream from the cutting position in the paper sheet conveyance direction is stored in the second storage unit.

4. The paper sheet conveying apparatus according to claim 1, wherein, after the jam detected with the detecting unit is resolved, the control unit cuts the second part positioned on the side upstream from the cutting position in the paper sheet conveyance direction to a predetermined length with the first cutting unit, and stores the paper sheet cut to the predetermined length in the second storage unit through the second conveyance path with the first conveyance unit.

5. The paper sheet conveying apparatus according to claim 1, further comprising:

a paper sheet binding unit configured to bind paper sheets stored in second storage unit, wherein the control unit binds the paper sheets cut to a predetermined length and stored in the second storage unit with the paper sheet binding unit.

6. The paper sheet conveying apparatus according to claim 5, wherein, when a predetermined number of paper sheets cut to the predetermined length are stored in the second storage unit, the control unit binds the paper sheets with the paper sheet binding unit.

7. The paper sheet conveying apparatus according to claim 5, wherein the control unit determines whether to bind the paper sheets cut to the predetermined length and stored in the second storage unit in accordance with a switch of settings by a user.

8. The paper sheet conveying apparatus according to claim 1, further comprising:

a third storage unit;

a third conveyance path used to convey the paper sheet to the third storage unit;

a fourth conveyance path provided on a side upstream from the first switching unit in the paper sheet conveyance direction;

a second conveyance unit configured to convey the paper sheet along the third conveyance path and the fourth conveyance path;

a second switching unit configured to switch the conveyance path of the paper sheet to one of the third conveyance path and the fourth conveyance path; and a second cutting unit provided on a side upstream from the second switching unit in the paper sheet conveyance direction and configured to cut the paper sheet at the cutting position, wherein, when the detecting unit detects a jam in a conveyed paper sheet, the control unit controls the first switching unit, the second switching unit, the first cutting unit, the second cutting unit, the first conveyance unit, and the second conveyance unit such that the conveyed paper sheets are cut to a predetermined length with the first cutting unit and the second cutting unit and stored in the second storage unit, the third storage unit, or both of the second storage unit and the third storage unit.

9. An image forming system comprising:

an image forming apparatus configured to form an image on a paper sheet; and a paper sheet conveying apparatus connected to the image forming apparatus, the paper sheet conveying apparatus including:

a first storage unit;

a second storage unit;

a first conveyance path used to convey a paper sheet to the first storage unit;

a second conveyance path used to convey the paper sheet to the second storage unit;

a conveyance unit configured to convey the paper sheet along the first conveyance path and the second conveyance path;

a switching unit configured to switch a conveyance path of the paper sheet to one of the first conveyance path and the second conveyance path;

a cutting unit provided on a side upstream from the switching unit in a paper sheet conveyance direction, the cutting unit being configured to cut the paper sheet at a cutting position;

a detecting unit configured to detect an occurrence of a jam; and a control unit, when the detecting unit detects a jam in the paper sheet conveyed on the first conveyance path, configured to cut the paper sheet, with the first cutting unit, into a first part in which the jam occurs and a second part in which the jam does not occur, the second part being positioned on a side upstream from the cutting position in the paper sheet conveyance direction, switch conveyance path of the paper sheet from the first conveyance path to the second conveyance path with the switching unit, and convey the second part of the paper sheet to the second storage unit through the second conveyance path with the conveyance unit while the first part of the paper sheet remains on the first conveyance path.

10. The paper sheet conveying apparatus according to claim 2, wherein the control unit is configured to cut a plurality of positions of the second part of the cut sheet which is previously cut to the predetermined length by the first cutting unit to form a plurality of cut sheets, and convey the plurality of cut sheets with the first conveyance nit so as to store the plurality of cut sheets in the second storage unit.

* * * * *